US009587384B2

(12) United States Patent
Schoolcraft et al.

(10) Patent No.: US 9,587,384 B2
(45) **Date of Patent: *Mar. 7, 2017**

(54) MODULAR SENSOR ACTIVATED FAUCET

(71) Applicant: Zurn Industries, LLC, Sanford, NC (US)

(72) Inventors: John Kevin Schoolcraft, Sanford, NC (US); Craig Saunders, Rocky River, OH (US); Paul Stephens, Twinsburg, OH (US); Jason Tilk, Cleveland Heights, OH (US); Alex Velet, Westlake, OH (US); Michael Liebal, Greensboro, NC (US); Sean M. Chenard, Raleigh, NC (US); Roy Leviner, III, Aberdeen, NC (US)

(73) Assignee: Zurn Industries, LLC, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/819,870

(22) Filed: Aug. 6, 2015

(65) Prior Publication Data

US 2015/0345120 A1 Dec. 3, 2015

Related U.S. Application Data

(63) Continuation of application No. 14/067,662, filed on Oct. 30, 2013, now Pat. No. 9,133,607.

(Continued)

(51) Int. Cl.

| | |
|---|---|
| ***E03C 1/05*** | (2006.01) |
| ***E03C 1/04*** | (2006.01) |

(52) U.S. Cl.

CPC ..... *E03C 1/057* (2013.01); *E03C 1/0404* (2013.01); *E03C 2001/0416* (2013.01);

(Continued)

(58) Field of Classification Search

CPC ..... E03C 1/057; E03C 1/0404; E03C 2001/0416; Y10T 137/9464

(Continued)

(56) References Cited

U.S. PATENT DOCUMENTS 4,894,874 A * 1/1990 Wilson ..... E03C 1/057 251/129.04

7,464,418 B2 * 12/2008 Seggio et al. ..... E03C 1/05 251/129.04

(Continued)

*Primary Examiner* — Kevin Lee

(74) *Attorney, Agent, or Firm* — Quarles & Brady LLP

(57) ABSTRACT

A modular sensor activated faucet assembly provides a spout that can be coupled and removed from its mounting base quickly and easily for installation and service. A water tight connection can be established between the mounting base and the spout without the use of tools or additional mechanical connections, thus allowing the spout to be installed by simply plugging into its base. A seamless spout construction defining a hollow interior bifurcated by integral internal wall structure provides a wet chamber between its mounting end and the outlet and a flow pipe inside the spout. The modular base provides a cooperating flow pipe. When the spout is mounted onto the base, the flow pipes are configured to nest together in close relation such that one or more seals can be disposed between the flow pipes to provide a water tight seal between the spout and base.

18 Claims, 13 Drawing Sheets

Related U.S. Application Data

(60) Provisional application No. 61/720,902, filed on Oct. 31, 2012.

(52) U.S. Cl.
CPC .. *Y10T 137/1842* (2015.04); *Y10T 137/86815* (2015.04); *Y10T 137/9464* (2015.04)

(58) Field of Classification Search
USPC ..... 137/315.12, 801
See application file for complete search history.

(56) References Cited

U.S. PATENT DOCUMENTS 7,735,519 B2 * 6/2010 Lin ..... E03C 1/0401 137/315.12
9,133,607 B2 * 9/2015 Schoolcraft et al. ... E03C 1/057

* cited by examiner

MODULAR SENSOR ACTIVATED FAUCET

CROSS-REFERENCE TO RELATED APPLICATIONS

This application is a continuation application of U.S. application Ser. No. 14/067,662, filed Oct. 30, 2013 now U.S. Pat. No. 9,133,607, and claims the benefit of U.S. Provisional Application No. 61/720,902, filed Oct. 31, 2012, the entire contents of which are hereby incorporated by reference into this application for all purposes.

STATEMENT REGARDING FEDERALLY SPONSORED RESEARCH

Not applicable.

FIELD OF THE DISCLOSURE

This disclosure relates to plumbing fittings, and more particularly to faucets with sensor activation.

BACKGROUND OF THE DISCLOSURE

For convenience, hygiene and the like, faucets have been fitted with one or more sensors (for example, infrared transmitter and receiver units) that can detect the presence of an object (for example, a hand or other body part) and can be used to activate the flow of water without direct physical contact with the faucet. Such "automatic" faucets are activated by placing an object in the vicinity of the outlet of the faucet spout, again without touching it directly. A sensor mounted within the spout detects the presence of the object and signals an electronic circuit to open a water valve controlling the flow of water to the spout. Automatic faucets of this type are common in public washroom facilities to reduce the transmission of germs and bacteria as well as to keep water from being wasted.

It is desirable that the automatic faucet, including the control module, be easily installed in the first instance, particularly since in public washrooms there are often banks of several sinks and faucets. It is also desirable for the electronic control module, including power supply, sensor and sensor wiring, to be readily serviceable (e.g., as much as possible providing above-deck access and replacement of the service components of the faucet with minimal disassembly). In a public setting, both ease of installation and serviceability considerations are contemplated in light of providing an aesthetic design (including, for example, the configuration of the spout and concealing the control features of the faucet) and making the faucet tamper resistant (e.g., preventing the spout from being compromised and the sensor disabled).

A common impediment to achieving an automatic faucet that satisfactorily combines the aforementioned design considerations is the requirement that the faucet maintains a sealed water path in communication with the building water supply. Typically, internal plumbing lines, either rigid or flexible, couple the outlet of the spout with the building water supply, such as by connection to an outlet side of the control valve at the underside of the sink deck. The below-deck connection can hamper serviceability.

To ease this problem, the faucet spouts can have a multi-part shell which can be disassembled from above the deck in order to access the plumbing lines. However, doing so creates seam lines that can detract from the appearance of the faucet. Even in single body spouts, the need to accommodate, the sometimes large or extra-length, plumbing lines can also impact the faucet aesthetics.

Furthermore, typical spout mounting arrangements in conventional automatic faucets have tamper resistant connections that make it difficult to remove the spout from its base. This not only can further hamper serviceability, it typically requires the spout and its base, in essence the entire faucet, to be replaced when replacement of just one of these components is required or desired. Thus, for example, it is generally not possible to update the look of the faucet by interchanging its existing spout with a spout of a new design having a different configuration.

SUMMARY OF THE DISCLOSURE

This disclosure provides a modular sensor activated faucet assembly in which the spout can be coupled and removed from its mounting base quickly and easily for installation and service. A water tight connection can be established between the mounting base and the spout without the use of tools or additional mechanical connections, thus allowing the spout to be installed by a simple plug-in type connection into its base. Different spouts having consistent coupling interfaces can be interchanged in this manner to allow for rapid replacement of spouts having like or different external designs.

In one aspect the disclosure provides an electronically operated faucet having a sensor for activating a control valve controlling flow of water to the faucet. A base can have a flow pipe extending along an upright axis. A spout defining a hollow interior can be bifurcated by an internal wall to provide a flow chamber between a mounting end and an outlet end of the spout. The spout can have another internal wall extending across the flow cavity as well as a flow pipe extending along the upright axis. The spout can be removably coupled to the base. When coupled, the cylindrical flow pipes can be configured to nest together in close relation such that at least one seal can be disposed between the flow pipes to provide a water tight seal of flow passing through the flow pipes and into the flow chamber of the spout.

In another aspect the disclosure provides an electronically operated faucet having a sensor, a spout, a mounting base and an electronic control valve. The spout can define an external shell providing a hollow interior and an internal wall structure extending into the hollow interior. The internal wall structure can include an outlet end wall, a base end wall and a partition wall extending between the end walls so as to divide the hollow interior into a dry chamber and a wet chamber, the dry chamber not in fluid communication with the wet chamber. The outlet end wall can have a first opening communicating with the dry chamber in which the sensor is received, and a second opening communicating with the wet chamber. The base end wall can have a first opening communicating with the dry chamber through which an electrical line passes to the sensor, and a second opening communicating with the wet chamber through which water is passed to the second opening of the outlet end wall. The second opening in the base end wall can have a flow pipe, for example, extending along an upright axis.

The mounting base can have a peripheral wall extending within the hollow interior of the spout. The mounting base can also have a flow pipe extending along the upright axis and sized to fit with the flow pipe of the base end wall to pass water through the flow pipes into the wet chamber of the spout. The mounting base can also have an opening communicating with the dry chamber through which an electrical line extends to the sensor. The electronic control valve can be electrically coupled to the sensor by the electrical line to control water flow to the wet chamber of the spout. The spout can couple to the mounting base by fitting together the flow pipes, and/or the shell and peripheral wall of the mounting base, in close fitting relation.

In yet another aspect the disclosure provides an electronically operated faucet having a sensor, mounting base and control module as described above, along with a mounting shank and at least one seal. The monolithic (seamless) spout can be formed as one piece to include the external shell and internal wall structure to define the wet and dry chambers and end walls, as stated above. The base end wall of the spout can define a flow pipe or merely an opening sized and located to fit about the flow pipe of the mounting base. At least one seal can be disposed between the flow pipes, or about the flow pipe of the mounting base. The mounting shank can have one end received in an opening in the mounting base and at least one internal passage for fluidly coupling the control module to the flow pipe(s) and the wet chamber of the spout.

These and other aspects and advantages of the modular faucet, including an above-deck mixing valve version thereof, disclosed herein will become better understood upon consideration of the detailed description of the drawings.

BRIEF DESCRIPTION OF THE DRAWINGS

Like reference numerals will be used to refer to like parts from figure to figure in the following detailed description.

DETAILED DESCRIPTION

Figure 1:
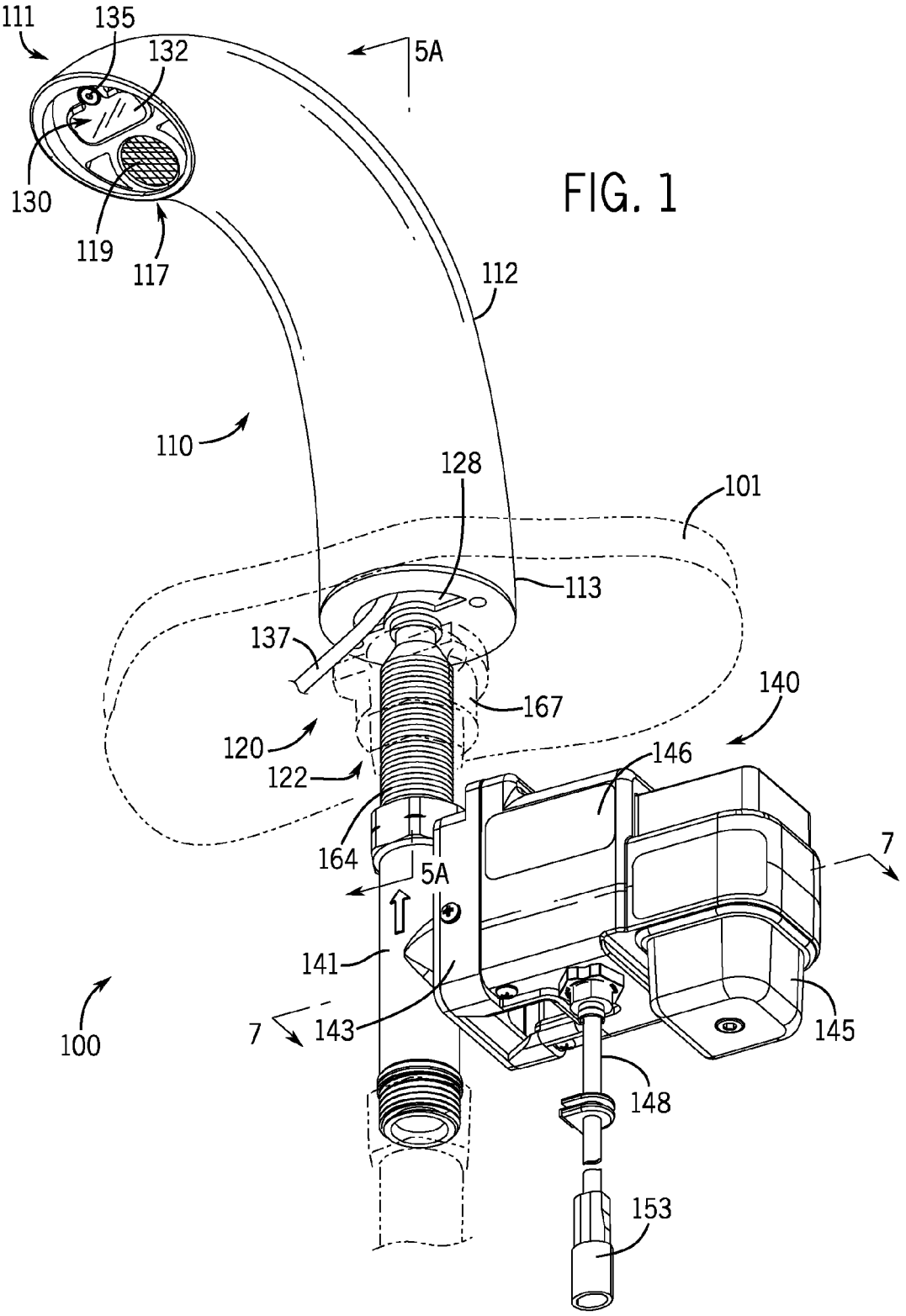
FIG. 1 is a perspective view of an example modular faucet assembly according to the present disclosure.

A non-limiting example of a modular faucet assembly is illustrated in FIGS. 1-9. Referring to FIG. 1, a modular faucet assembly 100 includes a spout 110, a base module 120 and a control module 140. The base module 120 is mounted within a mounting opening 102 in a surface 101, such as a sink deck (see FIGS. 5A-5B). The spout 110 removably couples to the base module 120, which extends through the mounting opening 102 to below the deck 101. A portion of the base module 120 below the deck 101 is coupled to the control module 140. The control module 140 is configured to couple to a fluid source, such as a building water supply, in order to control the passage of a fluid (e.g., water) to the base module 120 and the spout 110.

The spout 110 has an upper outlet end 111, a main body 112 and a lower base end 113. The spout 110 defines the external shell of the faucet 100 as well as internal wall structure 108 and 109 at or near the base 113 and outlet 111 ends, respectively. The body 112 of the spout 110 houses a sensor module 130 in electrical communication with the control module 140. A lens 132 of the sensor module 130 is disposed in the outlet end 111 of the spout 110. The position of the lens 132 enables the sensor module 130 to detect motion beneath or sense proximity of an object to the outlet end 111. For example, the sensor module 130 can detect the placement of a hand or a hand motion. The outlet end 111 further includes a fluid outlet 117 in communication with the fluid source through which fluid can pass. In basic operation, the sensor module 130 detects the object near the outlet end 111 of the spout 110 and signals the control module 140 to enable the passage of fluid from the fluid source, through the base module, into the spout body 112 and through the outlet 117. When the sensor module 130 no longer detects the object, the sensor module 130 signals the control module 140 to stop the passage of fluid from the source to the outlet 117. In summary, the modular faucet assembly 100 functions to allow a user to automatically wash his or her hands by simply positioning them beneath the sensor.

In one implementation, the spout 110 includes a bifurcated interior defining a dry chamber 115 and a wet chamber 116, both of which run between the base end 113 and outlet end 111 of the spout 110. FIGS. 1-9 illustrate one spout configuration, however, a bifurcated spout of other sizes and shapes can be used with this construction of the modular faucet assembly (see FIGS. 14-15). For example, the spout body 112 can be of any suitable size and shape, including round or rectilinear sections and profiles, and can be monolithic, in other words a seamless, unibody construction, or an assembly of multiple sections. As mentioned, however, this example illustrates that the modular faucet can have a spout body 112 that integrally provides the waterway and support structure for the internal components.

As shown in FIGS. 2-5B, the spout body 112 can be a seamless cast, unitary hollow body that is bifurcated by an integral internal partition wall 114 into two lengthwise passages or chambers, such as dry 115 and wet 116 chambers that extend between opposite ends of the spout 110. As shown, the partition wall 114 can be symmetrically or asymmetrically disposed within the interior of the spout 110 to define two equal or unequal chambers. For example, the wet chamber 116 can have a larger volume, and it can converge somewhat from the mounting end 113 to the outlet end 111 of the spout 110. The wet chamber 116 can extend to the base end wall 109 near the base end 113 of the spout 110 that couples to the base module 120. The base end wall 109 defines a flow tube or pipe flow pipe 103, defining a flow passageway and extending about an upright axis A (see FIGS. 5A-5B) of the spout 110, but otherwise extends across the wet chamber 116 to close off its lower end. At the outlet end 111 of the spout 110 is the outlet end wall 108 that has an outlet 117 for communicating water flow from wet chamber 116 and defining a recessed pocket in which an aerator 119 is mounted.

Figure 2:
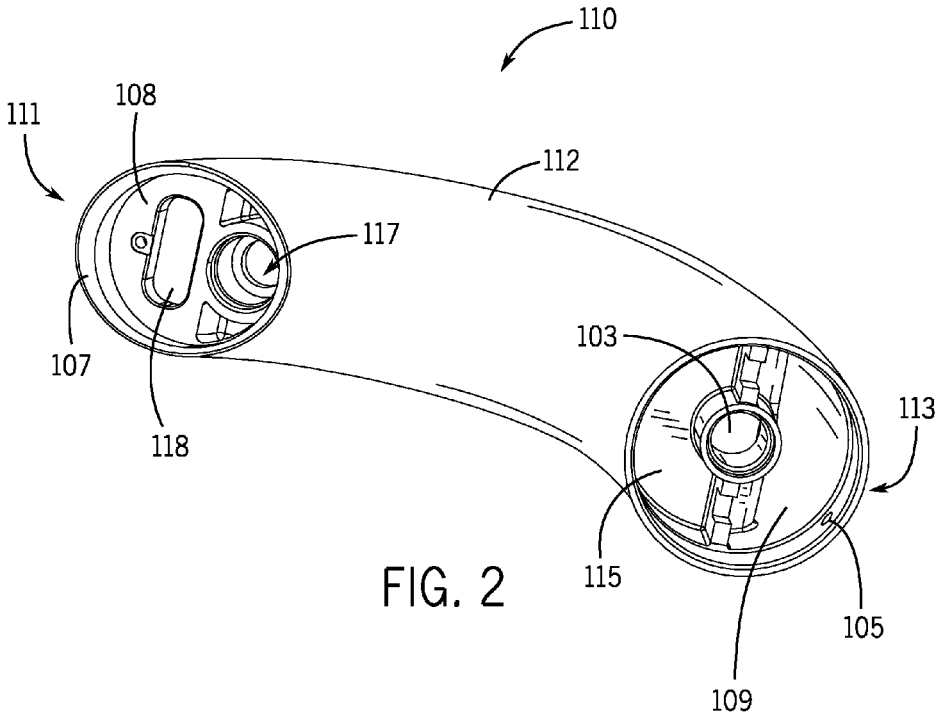
FIG. 2 is a bottom perspective view of a seamless spout body of the faucet of FIG. 1 shown in isolation.

The dry chamber 115, which can be smaller in volume, opens at the lower base end 113 of the spout 110 either through another opening in the base end wall 109, or in the configuration shown in FIG. 2 by bypassing the base end wall 109. The dry chamber 115 extends to the outlet end 111 of the spout 110, either by bypassing the outlet end wall 108, or as shown in FIG. 2 through an opening 118 in the outlet end wall 108. The internal partition wall 114 extends continuously and uninterruptedly between the end walls 108 and 109 and interior surfaces of the spout 110, and thus the dry chamber 115 is fluidly isolated from the waterway defined by the wet chamber 116. As such, the dry chamber 115 can contain electrical conduit 137 for the sensor module 130, which can be mounted to the opening 118 in the outlet end wall 108, without requiring being specially encased or sealed off at either end of the spout 110.

Figure 4:
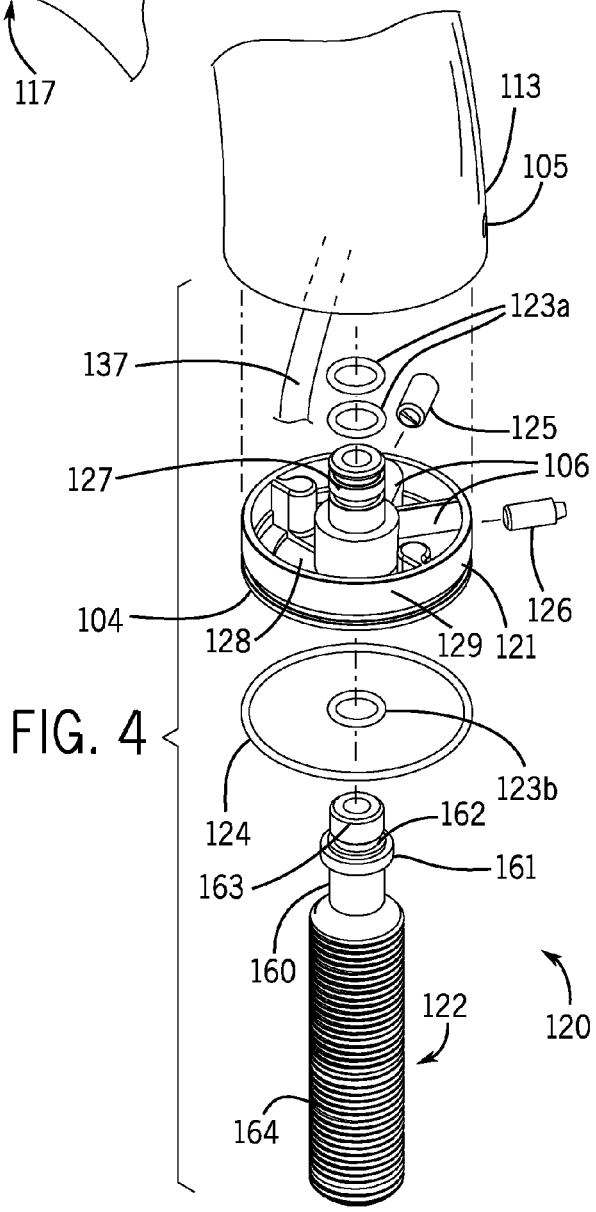
FIG. 4 is a partial perspective view of a base end thereof showing a modular mounting base in exploded assembly.
Figure 5A:
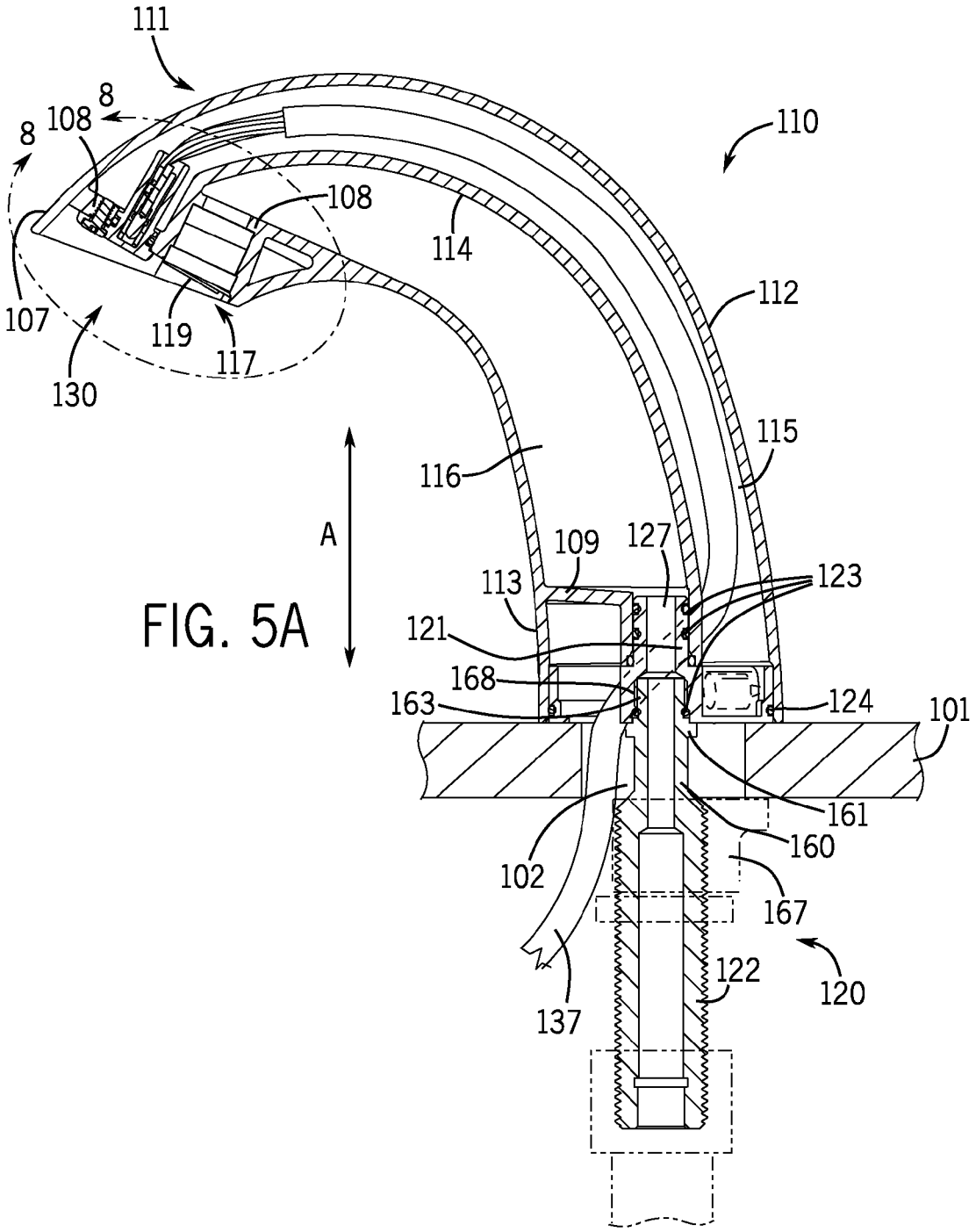
FIG. 5A is a cross-section view taken along line 5-5 of FIG. 1 showing a spout and mounting base thereof.
Figure 5B:
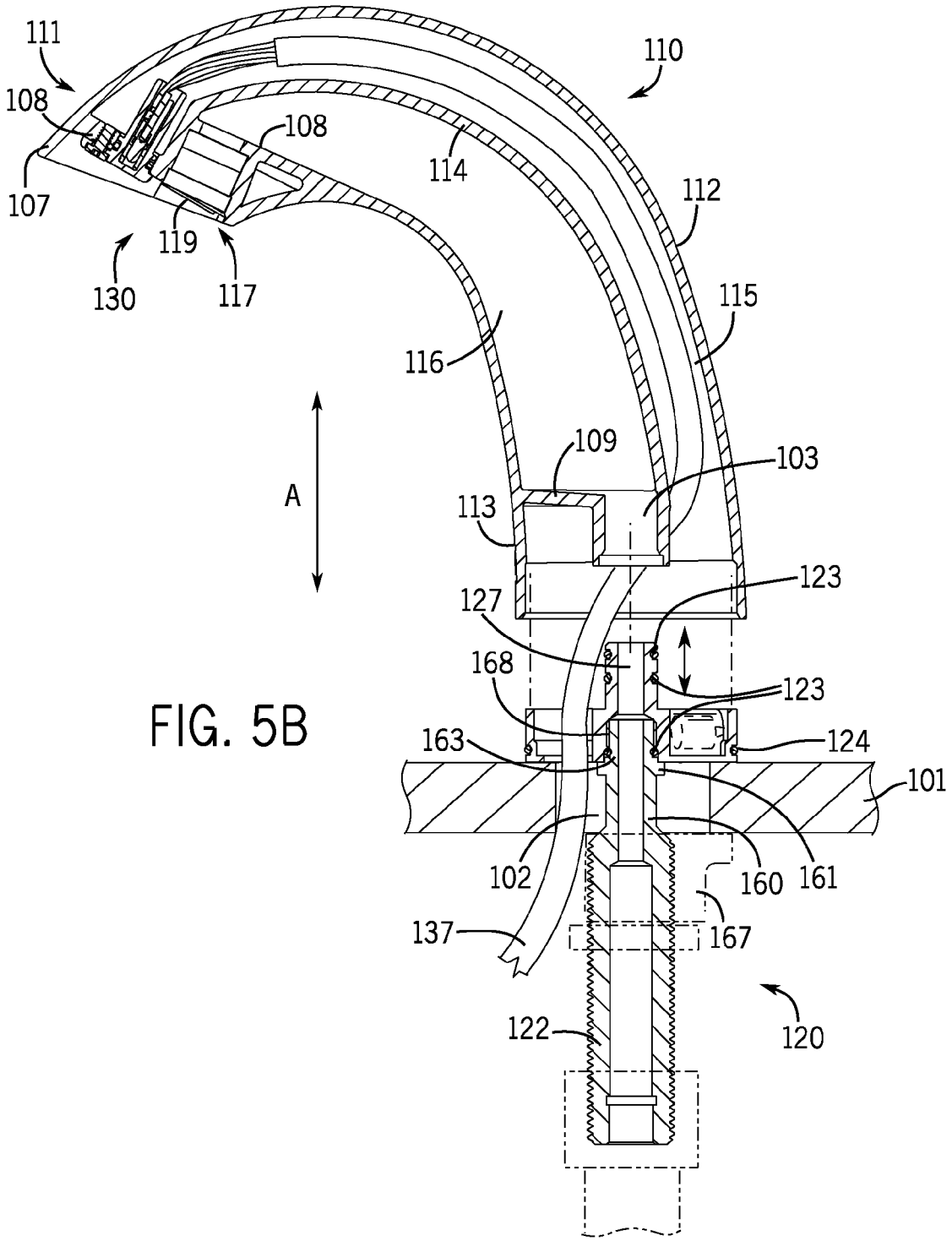
FIG. 5B is a cross-section view similar to FIG. 5A albeit showing the spout removed from the mounting base.

Referring now to FIGS. 4 and 5A-5B, the base module 120 includes a mounting base 121 and a hollow rod mounting shank 122. The mounting base 121 has a circular bottom wall, with an arc-shaped opening 128, and being sized larger than the mounting opening 102 so that the mounting base can be mounted to an upper surface of deck 101, while the mounting shank 122 extends through the mounting opening 102 of the deck 101. A narrow upper end 163 of the mounting shank 122 couples to the mounting base 121 above the deck 101 while an externally threaded lower end 164 extends below the deck 101. A nut or other fastener 167 (shown in phantom in FIGS. 1 and 5A-5B) can thread onto the lower end 164 and be tightened to clamp the deck 101 between the mounting base 131 and the fastener 167. The mounting base 121 includes a centrally positioned flow tube or pipe 127, defining a flow passageway therein and extending along the upright axis A of the spout 110 and can be sized to nest with, for example fit in close relation to and coaxially within, the flow pipe 103 of the base end wall 109 of the spout 110. The flow pipe 127 can have one or more, such as two axially spaced apart, circumferential grooves for positioning O-rings 123*a* spaced apart along the length of the flow pipe 127. The O-rings 123*a* can create a fluid tight seal between the flow pipes 103 and 127. A cylindrical peripheral wall 129 extends about the upright axis A at the periphery of the mounting base 121. A circumferential groove 104 in the peripheral wall 129 accommodates an O-ring 124. A cylindrical opening 168, or an enlarged portion of the flow pipe 127, receives the upper end 163 of the mounting shank 122. The mounting shank 122, has a circumferential groove 162 positioned between the upper end 163 and a flange 161 having a greater diameter than the upper end 163 received in the mounting base 121. The groove 162 accommodates an O-ring 123*b* for forming a fluid tight seal with an interior wall of the mounting base 121 at the cylindrical opening 168 in conjunction with the flange 161, which abuts a bottom surface of the mounting base 121. Note that while flow pipes 103 and 127 are shown to be cylindrical, flow pipes having different cross sections, for example including rectangular, oval or "D"-shaped can be used, provided the flow pipes are complementary. Furthermore, the flow pipes can be either coaxial with a central axis of the spout such as upright axis A, or on other axis different from the central axis of the spout. Still further, while both the base end wall 109 of the spout 110 and the mounting base 121 are shown and described herein as defining integral flow pipes, only one of these components could be configured with a flow pipe. The other could be an opening of complementary shape, such as in the base end wall 109, to receive the flow pipe 127 without having a corresponding length that extends along and nests with the flow pipe 127.

With reference to FIGS. 5A and 5B, the base end 113 of the spout 110 is configured to couple to the mounting base 121 by simply fitting the spout 110 down over the mounting base 121 in a simple plug-in type connection. The spout 110 decouples from the mounting base 121 by simply unplugging it (i.e., lifting it up and away from the mounting base 121). More specifically, the spout 110 interfaces with the mounting base 121 primarily (if not entirely) at the interface of the flow pipes 103 and 127 with each other and the interface of the spout body 112 and the peripheral wall 129. That is, in the example faucet 100, the spout 110 is positioned so that the flow pipe 103 formed in the base end wall 109 extends downwardly along the upright axis A and is fit around the flow pipe 127, which extends upwardly along the upright axis A. At the same time, the base end 113 of the spout 110 fits coaxially around the peripheral wall 129 of the mounting base 121. The nested structures can be brought in close relation, and if desired can be sized to contact the associated nested structure. The O-rings 123*a* and the O-ring 124 provide a snug, solid connection, and as mentioned at the interface of the flow pipes 103 and 127, a fluid tight seal. O-rings 123*a* and 124 thus further contribute to the coupling of the spout 110 to the mounting base 121. Further, when assembled, the mounting base 121 can be completely or partially concealed by the spout 110.

The example modular assembly of the faucet 100 allows the same base module 120 and control module 140 to be used with different spouts. For example, this modular construction permits replacement of the spout of previously installed faucet for functional or aesthetic reasons without replacing, or even disassembling, the other components of the faucet. Spouts having different external configurations but a common interface at the base end can be interchangeably mounted to the base module 120, thereby allowing for the faucet to be given an entirely different look, since the spout is the primary, if not only, externally visible component above the mounting deck. Moreover, the spout can be installed and removed from above the mounting deck to accommodate a wider range of spout designs and sizes, where only the spout 110 and sensor module 130 would be replaced.

The aforementioned connection is sufficient to securely couple the spout 110 to the mounting base 121 as needed during use of the faucet 100. However, the spout 110 can be further secured to the mounting base 121 so as to prevent unwanted rotation or removal of the spout 110 from the mounting base 121, for example, thus making it tamper resistant for use in public washrooms. For example, to further secure the spout 110 to the mounting base 121, two openings 106 can be located in the peripheral wall 129 of the mounting base 121 to receive fasteners 125 and 126. In one embodiment, the fastener 125 is a spring-biased locking pin and the fastener 126 is a screw. The spout 110 then has at least one hole 105 for aligning the spout 110 with the mounting base 121 and for receiving fasteners 125 and 126.

Various other mechanisms and fasteners can be used in addition to or in place of fasteners 125 and 126 to removably secure the spout 110 to the mounting base 121, including without limitation threaded fasteners, rivets, magnets, a threaded connection between the spout and mounting base, adhesives, welds, solder and a press-fit. The mounting base 121 can have a pocket that receives a movable detent or other mechanical locking features. Furthermore, the peripheral wall 129 of the mounting base 121 can have a keyed shape that corresponds to a keyed opening defined by an interior surface of the base end 113. For example, the peripheral wall 129 can have a D-shape with the inner surface of the base end 113 having a complementary shape to align with the mounting base 121 in a predetermined manner. The choice of a keyed inner face of the peripheral wall 129 advantageously prevents the complementary base end 113 of the spout 110 from rotating about the upright axis A. Alternatively, or in addition, flow pipe 127 of the mounting base 121 can have a keyed shape that corresponds to a keyed opening defined by an interior surface of the flow pipe 103 of the spout 110. By analogy, the keyed face of the flow pipes would advantageously prevent the spout 110 from rotating about the upright axis A.

Various mechanisms can be used to disconnect the spout 110 from the mounting base 121 depending on the connection mechanism employed, including without limitation suitable tools (e.g., screwdriver, wrench, hex wrench, pliers, etc.) and solvents. And, even various mechanisms can be used to release the spring-biased locking pin. For example, the locking pin can be magnetic, and held in a magnetically insulating collar or guide, such that magnetic flux from a magnetic key of opposing polarity can drive the pin to compress the spring sufficiently so that the pin is no longer within a pocket, in which case the spout 110 can be simply lifted up from the base 121. A mechanical device, such as a small tool, pin, clip or the like can be used inserted into an opening in the spout 110 to directly contact the pin and drive it back against the spring to release the spout 110. Both options provide a tamper-resistant means of both locking and releasing the spout 110.

The base module 120 can be any suitable construction such as cast or machined brass, molded plastic, or composite plastic with brass inserts. Also, suitable seals, gaskets and other connectors can be used in addition to or in place of O-rings 123 and 124 to provide water-tight connections at the spout-base module interface. Water-tight connections can also be included for assembling the sensor module 130 and the aerator 119 with the spout 110. Moreover, the spout 110 can be secured to the base module 120 in any suitable manner, including the spring-biased locking pin and removable connection mechanisms to provide a tamper-resistant connection of the spout 110 to the deck 101.

Figure 6:
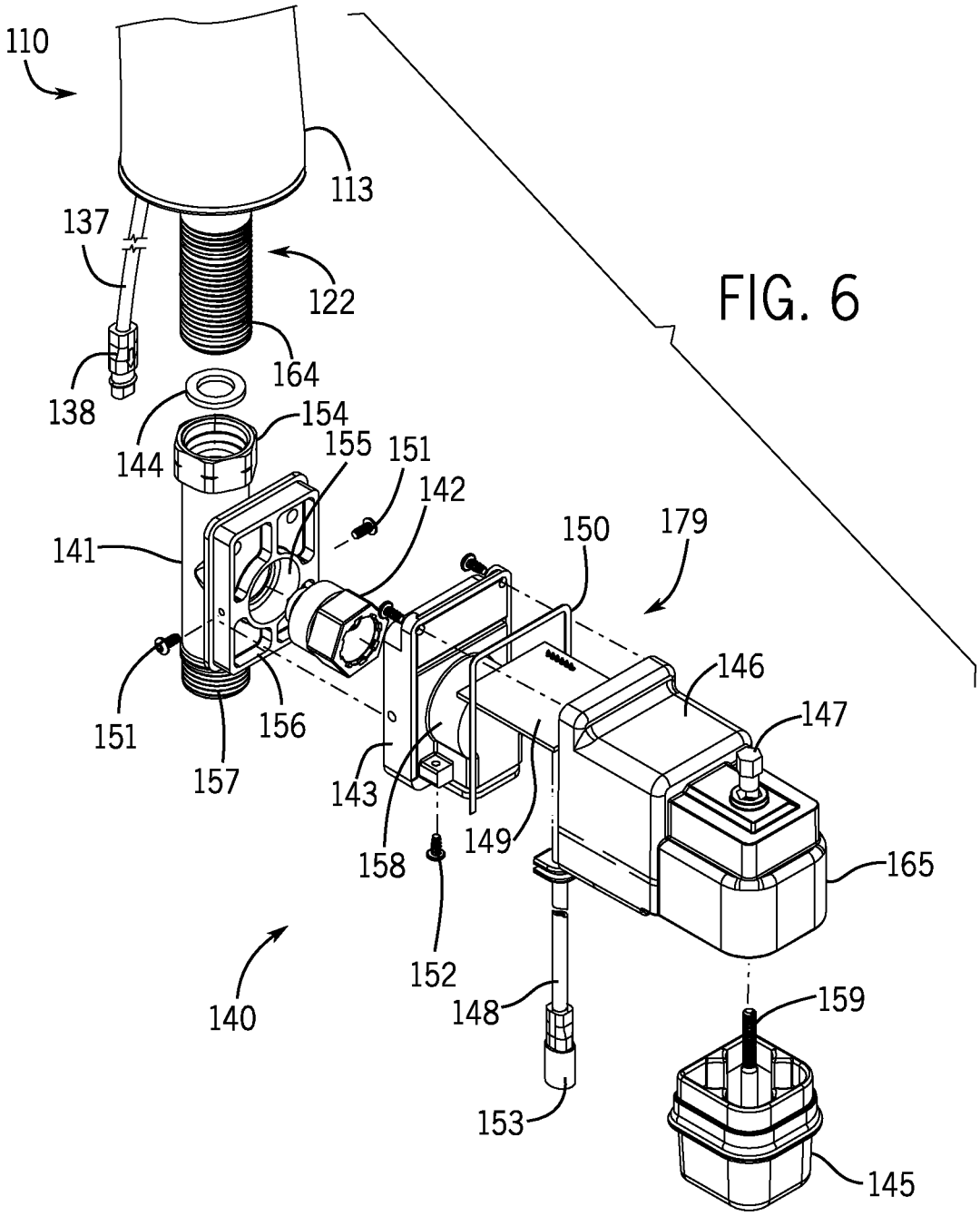
FIG. 6 is a partial perspective view of the base end of the faucet of FIG. 1 showing a mounting shank and control module in exploded assembly.
Figure 7:
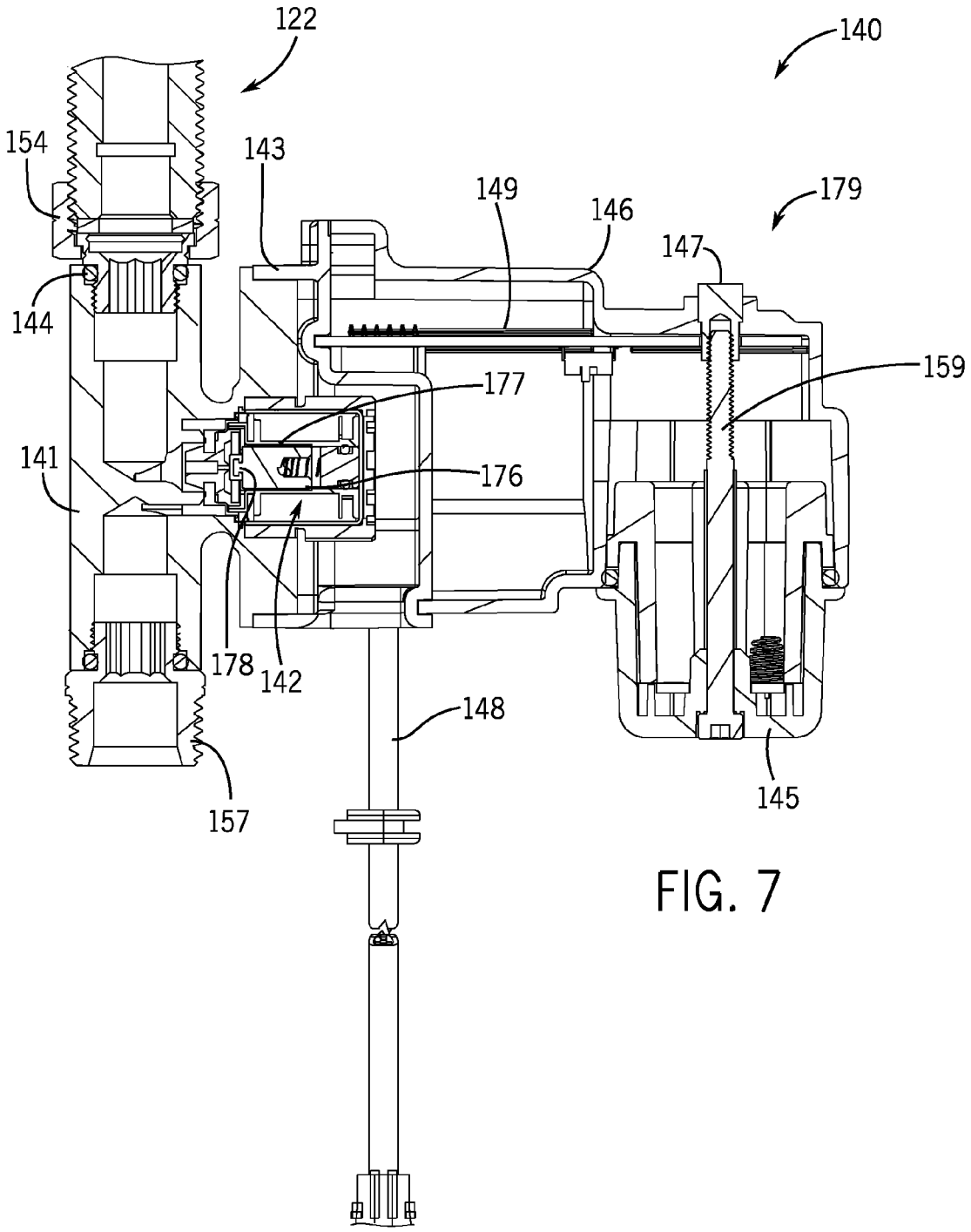
FIG. 7 is an enlarged partial cross-section view taken along line 7-7 of FIG. 1 showing the mounting shank and control module.

Referring now to FIGS. 6 and 7, an example control module 140 of the modular faucet assembly 100 is shown. The control module 140 includes a solenoid valve 142, including a spring biased plunger 176, wire coil 177 and valve head 178, which is operated by a battery powered electronic control unit 179. The control module 140 further includes a valve body 141 with upper and lower threaded ends 154 and 157, respectively. A water supply line (not shown) connects to the lower threaded end 157 to provide water to the valve body 141 and an inlet orifice 169 metered by the solenoid valve 142. The threaded end 164 of the mounting shank 122 couples to the upper threaded end 154 of the valve body 141. A gasket 144 is positioned between the threaded end 164 of the mounting shank 122 and the outlet end 154 of the valve body 141 to form a water-tight seal. The valve body 141 is in fluid communication with a valve housing 156. The valve housing 156 has a passage 155 in which the solenoid valve 142 is located. Energizing the solenoid valve 142 moves the plunger 176 along its stroke axis to unseat the valve head 178 to permit fluid flow through the valve body 141. The valve housing 156 is sealed by coupling to a spray shield 143, which also contains a recess 158 for accommodating the plunger 142. The plunger housing 156 and spray shield 143 can be coupled together with fasteners 151.

In addition to sealing the valve housing 156, the spray shield 143 functions to protect the components of the battery powered electronic control unit 179. The electronic control unit 179 includes an electronics housing 146 of which an end wall is formed by spray shield 143. A gasket 150 is positioned between the housing 146 and the spray shield 143 to form a water-tight seal. The electronics housing 146 contains a printed circuit board (PCB) 149 containing suitable control electronics, such as a microprocessor, a memory storage device storing executable commands and control data, timing circuitry and the like (not shown). The PCB 149 is in electrical communication with the sensor module 130, the solenoid valve 142 and a power supply or battery pack 145. One example of a suitable battery pack includes one or more AA batteries. A threaded bolt 159 extending from battery pack 145 is positioned in a compartment 165 of housing 146 in order to couple to a hex nut 147 positioned in an opposing face of the compartment 165. The result is that battery pack 145 is coupled to the electronics housing 146.

An additional component of the control module 140 is a wire, bus or other electrical conduit 148 with a terminal connector 153. The conduit 148 is in communication with the PCB 149 for receiving signals from sensor module 130. A sensor conduit (wire, bus, etc.) 137 of the sensor module 130 terminates in a sensor connector 138 which couples to connector 153. FIGS. 4 and 5A-5B illustrate an example path of the sensor conduit 137. Specifically, the conduit 137 is routed from the outlet end 111 of the spout 110, through the dry chamber 115, and through the opening 128 in the mounting base 121. The conduit 137 is connected below the deck 101 to conduit 148 by way of the connectors 138 and 153. Thus, the PCB 149 receives an input signal from the sensor module 130 via conduit 137 when the presence of a hand or other object near the spout 110 is sensed and energizes the solenoid valve 142 to open, and thereby water to flow through the valve body 141, into the mounting shank 122, through the flow pipes 103 and 127, into the wet chamber 116 of the spout 110 and out through the outlet. The control circuitry can then close the solenoid valve 142 after receiving input from the sensor module 130 that the object has been removed from nearby the spout 110. As is known, timing circuitry can be used to provide flow for pre-set time period in order to resist tampering.

Figure 9:
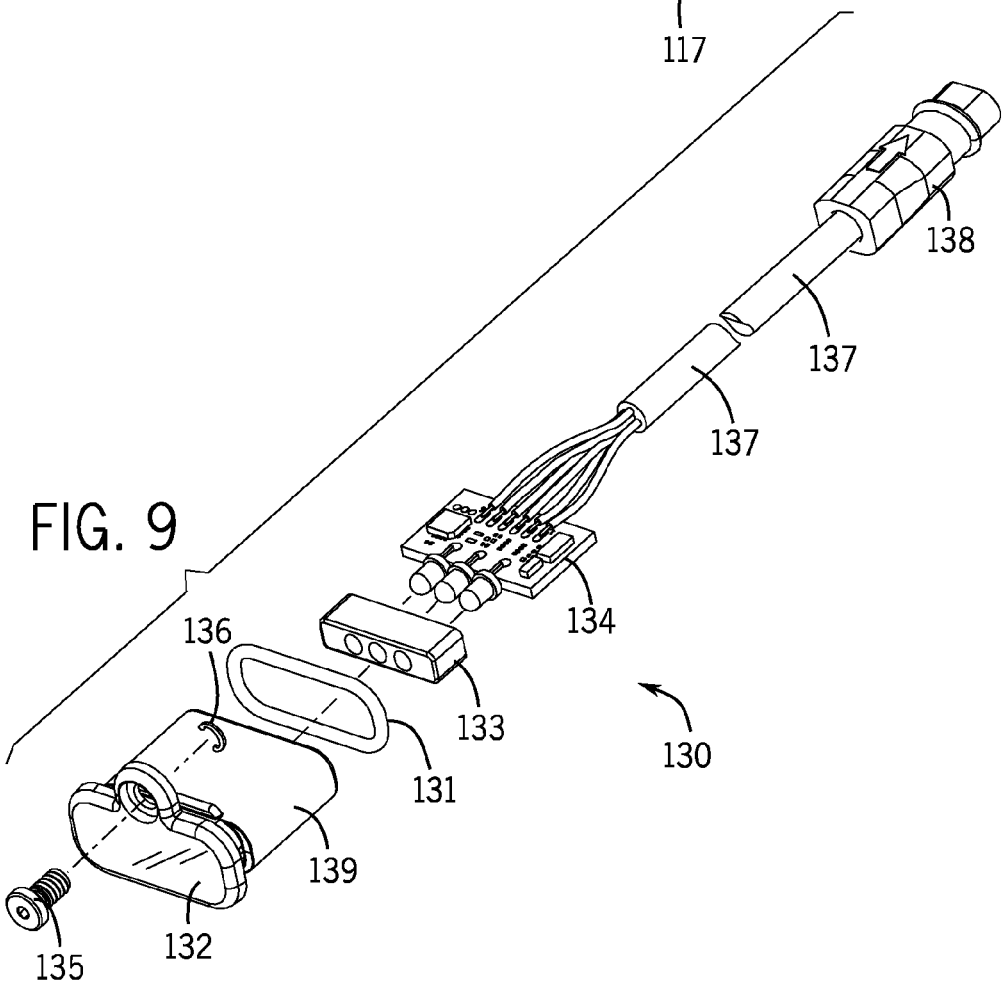
FIG. 9 is an exploded view of the sensor assembly in isolation.

Referring to FIG. 9, the components of an example sensor module 130 will now be described. The sensor module 130 includes a sensor board 134 connected to conduit 137. A portion of the sensor board 134 is nested in a bezel 133, which in turn is nested in a housing 139. A lens 132 is positioned on one end of the housing 139, while the conduit 137 extends out of the opposing end of the housing 139. FIG. 9 further shows a fastener 135 and retaining ring 136 for positioning the sensor module 130 in the spout 110 as well as an O-ring 131 for providing a water-tight seal.

Figure 3:
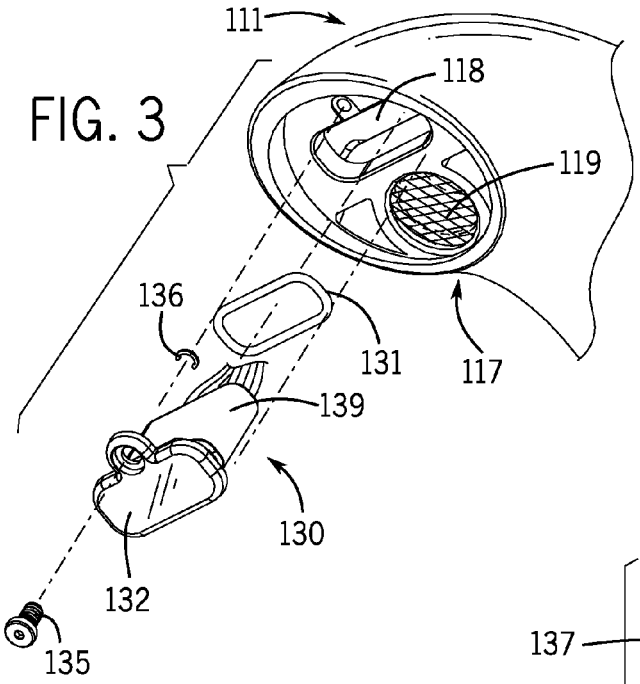
FIG. 3 is an enlarged partial perspective view of an outlet end of the faucet of FIG. 1 showing a sensor assembly exploded from the spout body.

Turning now to FIG. 3, integration of the sensor module 130 into the outlet end 111 of the spout 110 is shown. An opening 118 in the outlet end wall 108 of the spout 110 is sized to accommodate the housing 139 of the sensor module 130. The O-ring 131 is positioned around the housing 139 and between the lens 132 and the opening 118 to form a water-tight seal. The fastener 135 is routed through a hole in the lens 132 and can be held in place prior to installation by the retaining ring 136. The fastener 135 is received in a hole above the opening 118 in order to couple the lens, and therefore the sensor module 130 to the spout 110. FIG. 1 shows a view of the assembled spout 110 with the sensor module 130, where only the lens 132 and fastener 135 components are visible.

As shown in FIG. 5A, the end of the sensor module 130 including the sensor board 134 is positioned in the outlet end wall 108 of the spout 110. The conduit 137 in connection with the sensor board 134 exits the housing 139 and travels through the spout 110 to the space below the deck 101. From FIG. 8, it can be seen that an overhanging surface 107 of the spout 110 extends below lens 132, as well as the rest of the sensor module 130 with the exception of the conduit 137 and connector 138 by virtue of the passage of the conduit through the spout 110 and below the deck 101. The fastener 135 is shown to pass through the lens 132 and into the end wall 108 of the spout 110. Furthermore, the housing 139 is positioned in the dry chamber 115. A view of the nested housing 139, bezel 133 and sensor board 134 is also shown. As shown, both the sensor module 130 and the aerator 119 are essentially concealed from the view of a user by an overhanging surface 107 of the spout 110.

Figure 8:
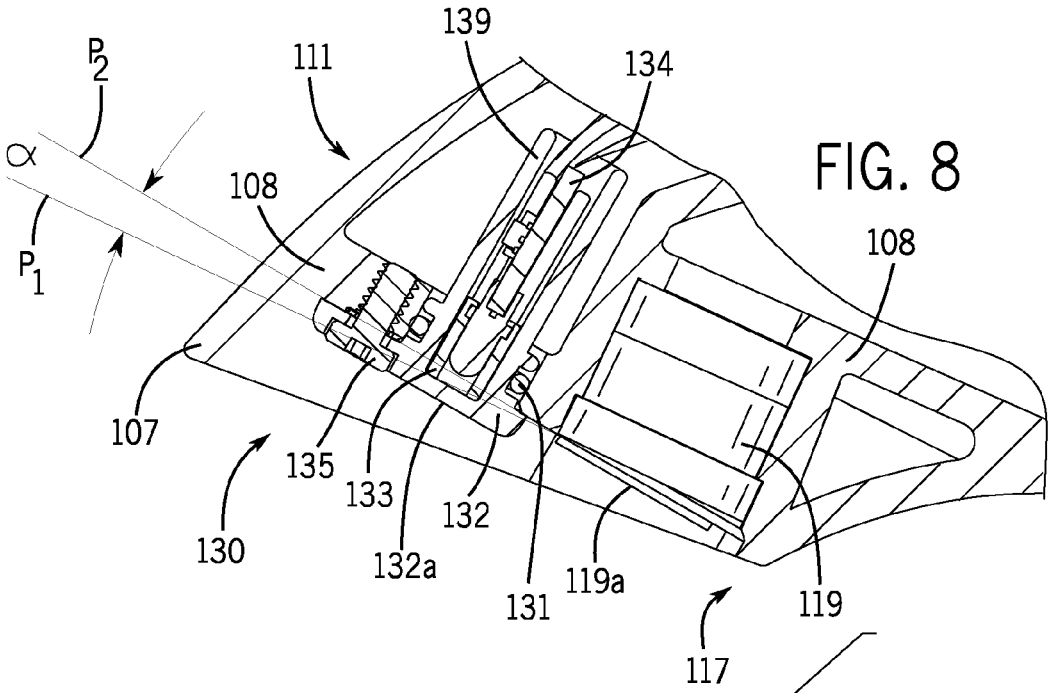
FIG. 8 is an enlarged partial perspective view of the outlet end of the faucet of FIG. 1 as taken along arc 8-8 of FIG. 5A.

With continued reference to FIG. 8, the positioning of the sensor module 130 is shown with respect to aerator 119. In some embodiments of the modular faucet assembly 100, the aerator 117 is advantageously mounted at an angle, $\alpha$, relative to the lens 132 of the sensor module 130. In particular, an end face 119*a* of the aerator 119 visible from beneath the outlet end 111 of the spout 110 is mounted such that the end face 119*a* is positioned in a first plane, $P_1$. Moreover, an end face 132*a* of the lens 132 visible from beneath the outlet end 111 of the spout 110 is mounted such that the end face 132*a* is positioned in a second plane, $P_2$, at the angle, $\alpha$, relative to the first plane $P_1$. Generally, the angle $\alpha$ has a value from about 0° to about 10°, preferably about 3° to about 7° and more preferably about 5°. Mounting the aerator 119 in a plane at a prescribed angle in this manner from the angle of the plane of the lens 132 provides several advantages. For example, when the faucet is in operation, a water stream flowing from the fluid outlet 117 is angled away from the lens 132 of the sensor module 130. Therefore, the lens 132 is less susceptible to either splashing or false detection of the water stream as an object by the sensor module 130. Also, the lens 132 is angled up from the aerator 119 to detect objects positioned above the sink, whereas the aerator 119 is angled down from the lens 132 to direct a water stream flowing from the fluid outlet 117 downward into the sink.

In FIGS. 1-8, the sensor module 130 is shown positioned above the aerator 119. However, in other embodiments, the sensor module 130 can be positioned above, that is outward of, the aerator 119, or below (or inward of) the aerator 119, or in any other suitable location or orientation to be able to detect the presence of an person's hands or other objects within the basin of the lavatory, without detecting the presence of objects elsewhere. The sensor module 130 and aerator 119 can be any suitable conventional devices, including known filter and aerator cartridges and any suitable infrared, capacitance, ultrasonic field or other known sensor technology for sensing the presence or motion of an object.

Figure 10:
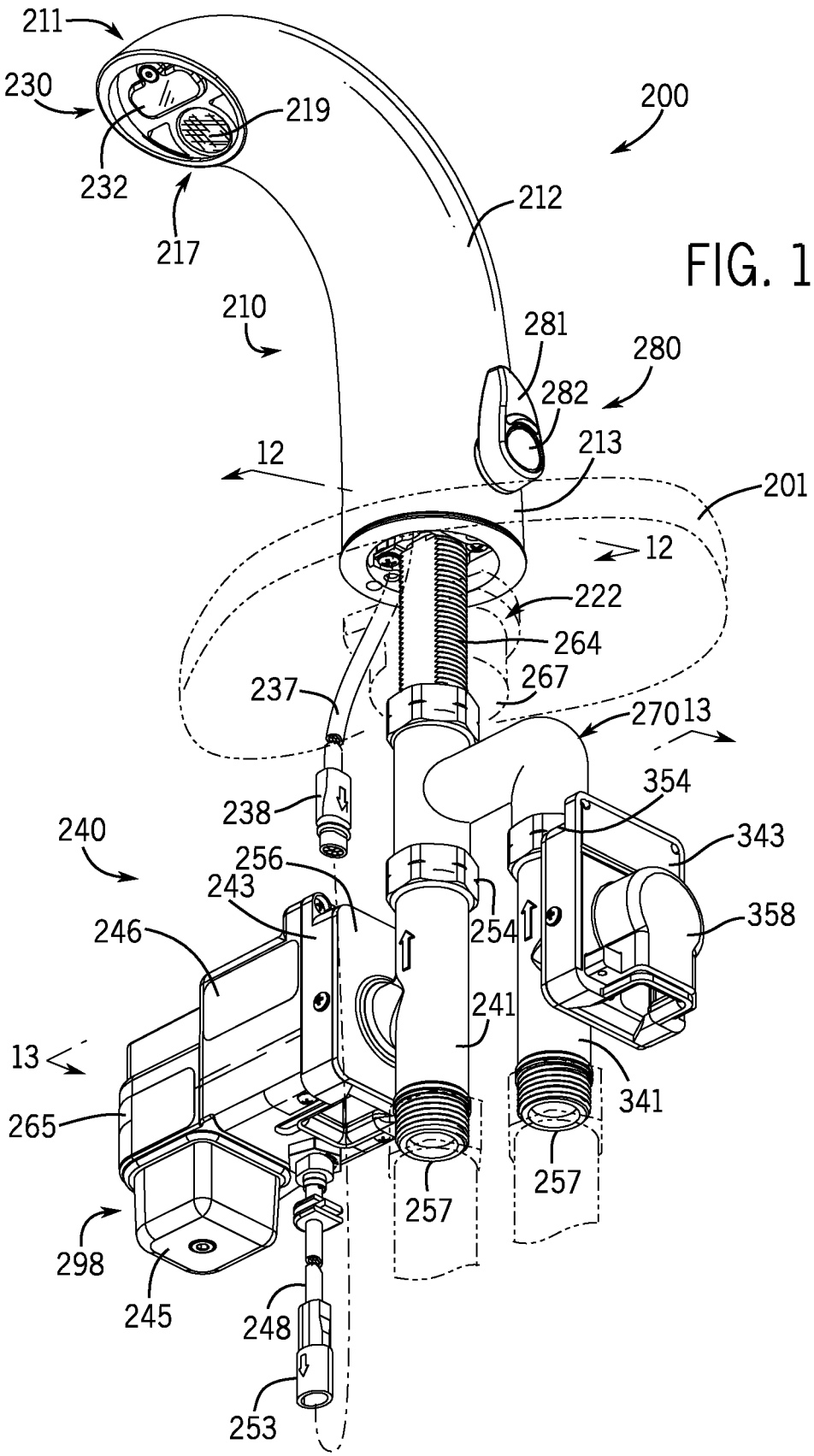
FIG. 10 is a perspective view of another example modular faucet assembly with above-deck mixing capabilities.

Turning now to FIGS. 10-16, a second non-limiting example of a modular faucet assembly 200 with an above deck mixing functionality is shown. Note that parts identified for the assembly 200 that correspond to parts identified for assembly 100 are labeled with like numbers. For example, spout 110 in assembly 100 corresponds to spout 210 in assembly 200. Referring to FIG. 10, a modular faucet assembly 200 includes a spout 210, a base module 220 and a control module 240. The spout 210 is mounted to a surface 201, such as a sink deck. The spout 210 removably couples to the base module 220, which in turn extends through the deck 201. A portion of the base module 220 below the deck 201 is coupled to the control module 240. Control module 240 is configured to couple to a fluid source in order to control the passage of a fluid (e.g., water) to the base module 220 and the spout 210.

As described for assembly 100, the spout 210 includes an outlet end 211, a body 212 and a lower base end 213. The spout 210 defines the external shell of the faucet 200 as well as internal wall structure 208 and 209 at or near the base 213 and outlet 211 ends, respectively. The body 212 of the spout 210 houses a sensor module 230 in electrical communication with the control module 240. A lens 232 of the sensor module 230 is disposed in the outlet end wall 208 of the spout 210. The position of the lens 232 enables the sensor module 230 to detect the presence or motion of an object beneath the mouth 211. The outlet end wall 108 further includes a fluid outlet 217 in communication with the fluid source through which fluid can pass. As in assembly 100, the modular faucet assembly 200 functions to allow a user to automatically wash his or her hands by simply placing his or her hands in the path of the sensor.

An additional component of spout 210 is an on-board, or above deck mounted (ADM), mixing valve module 280 for mixing multiple fluid streams, such as relatively cold and hot water flow streams. In order to accommodate the manually-operable mixing valve 280 in the faucet 200, the spout 210 includes an opening 202 for connecting the control lever or handle 281 to the mixing valve module 280 so that it is accessible when the faucet is fully assembled, as shown in FIG. 10.

FIG. 10 also shows additional components of assembly 200 that are located below the mounting deck, including a branch connector tube 270. Branch connector tube 270 couples base module 220 to a first valve body 241 of control module 240 as well as a second valve body 341 (parts identified for the control module 340, including valve body 341, correspond to parts identified for control module 240, and are labeled with like numbers). The faucet assembly 200 includes two solenoid valves 242 and 342 in order to accommodate two fluid streams. In one aspect, a first solenoid valve 242 regulates the supply of a relative cold water source while a second valve 342 regulates the supply of a relatively hot water source. As a result, cold and hot water sources can be mixed through operation of ADM module 280 to regulate the temperature of the water exiting the spout 210.

Figure 11:
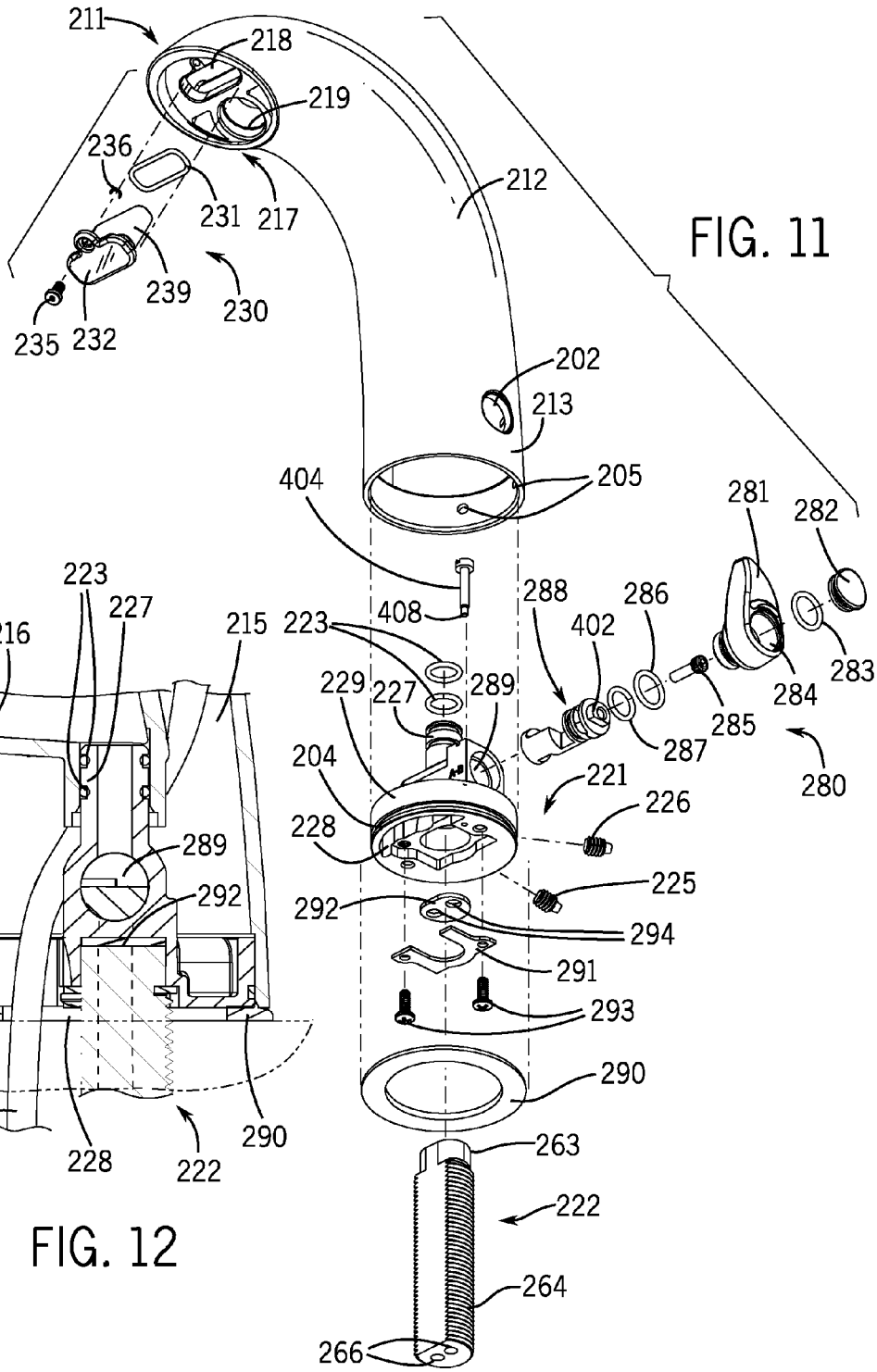
FIG. 11 is an exploded assembly view thereof without the control module shown in FIG. 10.
Figure 12:
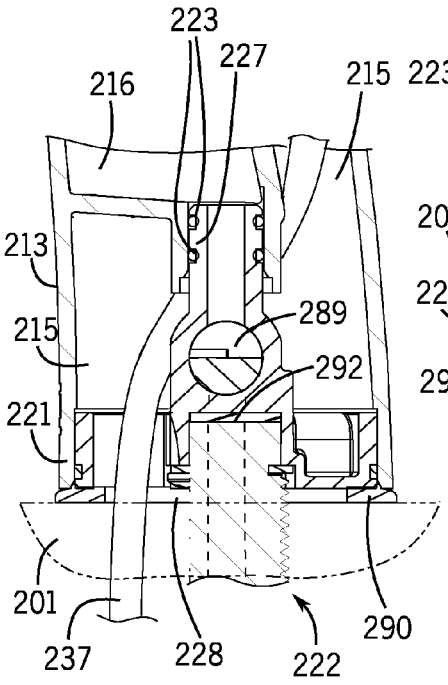
FIG. 12 is an enlarged partial cross-section view taken along line 12-12 of FIG. 10 showing a base end of the faucet.

As with spout 110, in one implementation spout body 212 has a bifurcated interior defining a dry chamber 215 and a wet chamber 216, both of which run between the lower end 213 and outlet end 211 of the spout 210 (see FIG. 12). FIGS. 10-16 illustrate one spout configuration, however, a bifurcated spout of other sizes and shapes can be used with this construction of the modular faucet assembly 200. Also, the spout body 212 can be of any suitable size and shape, including round or rectilinear sections and profiles, and can be monolithic (e.g., a seamless casting) or an assembly of multiple sections.

Figure 13:
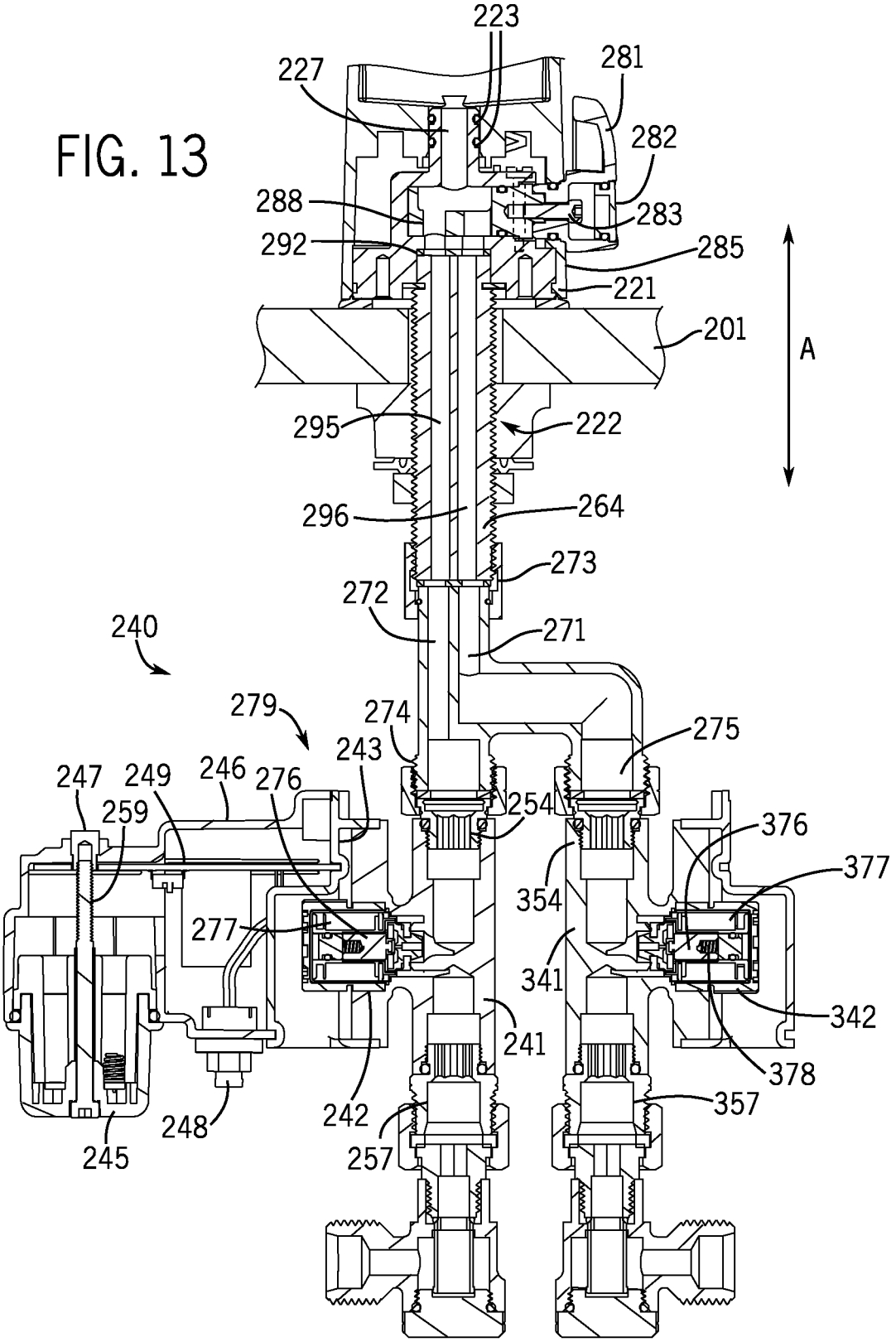
FIG. 13 is a partial cross-section view taken along line 13-13 of FIG. 10 showing the base and control modules of the faucet.

Referring now to FIGS. 11-13, the base module 220 includes a mounting base 221 and a mounting shank 222. The mounting base 221 is mounted to an upper surface of deck 201, while the mounting shank 222 extends through the mounting opening in the deck 201. An upper end of the mounting shank 263 couples to the mounting base 221 above the deck 201 while a lower threaded end 264 of the mounting shank 222 can be secured below deck 201 with a nut or other fastener 267 (shown in phantom in FIG. 10). The mounting base 221 includes a centrally positioned flow pipe 227 having grooves for positioning two O-rings 223 spaced apart along the length of the flow pipe 227. Furthermore, a groove 204 is positioned in a peripheral wall 229 of the mounting base 221 to accommodate an O-ring 224. The interior of the flow pipe 227 is shaped to receive the upper end 263 of the mounting shank 222.

Referring to FIGS. 11-13, the mounting shank 222 is bifurcated by a partition wall defining two distinct passages 295 and 296. The passages 295 and 296 terminate at openings 266 at each end of the mounting shank 222. The first passage 295 is in fluid communication with a first fluid source, such as a relatively cold or hot water source, by way of passage 272. Similarly, the second passage 296 is in communication with a second fluid source, such as a relatively hot or cold water source, by way of passage 271. Passage 271 is not in fluid communication with passage 272. Thus, for example, separate water streams can pass respectively through the passages 295 and 296 to components of the ADM module 280 in mounting base 221 as discussed below. Although the illustrated mounting shank 222 is bifurcated, alternative mounting shank 222 designs are possible. For example, a mounting shank 222 can include a first tube positioned with a second tube, wherein each tube defines a single passage. Water-tight seals on the ends of the tubes can maintain two distinct flow passages in order to achieve a similar result to the bifurcated mounting shank 222.

Additional components of base module 220 include a disk 292 positioned between the mounting base 221 and the upper end 263 of the mounting shank 222. The disk 292 includes holes 294 that align with channels 266 in the mounting shank 222 to allow for fluid flow between the mounting shank 222 and the mounting base 221. A ring 290 and a bracket 291 are also disposed between the mounting base 221 and deck 201. As shown in FIG. 12, the ring 290 also contacts the lower end 213 of the spout 210 while bracket 291 slots into a recess in the mounting base 221.

The mounting base 221 further includes a valve housing 289 for the mixing valve or mixing spool 288 of ADM module 280. The valve housing 289 is a crosswise bore that intersects the flow pipe 227 of the mounting base 221 such that mixing spool 288 can operate to regulate the flow out hot and cold water sources in order to regulate the temperature as described above. The mixing spool 288 couples to handle 281 through an opening in spout 210 by way of a fastener 285 and end cap 282. Seals, such as O-rings 283, 286 and 287 provide a water-tight seal between the valve handle 281, the mixing spool 288 and the mounting base 221.

Referring to FIGS. 11 and 14-16, the mixing spool 288 includes a keyed end face 402 configured to couple to handle 281. In particular, the inner surface of the valve handle 281 defining the space 284 is shaped so as to be complementary to the keyed end 402. When the mixing spool 288 is positioned in the valve housing 289 in the mounting base 221, a pin 404 can be inserted through an upper opening in the mounting base 221 in order to pass through a groove 406 in an end of the mixing spool 288. A lower end 408 of the pin 404 can couple to the mounting base 221. With the pin 404 in place, the mixing spool 288, and thereby the valve handle 281, are prevented from separating from the mounting base 221, while being able to rotate about an axis A', which can be aligned cross-wise, such as perpendicular, to the upright axis A. By sizing the circumferential extent of the groove 406, the mixing spool 288, and thus the valve handle 281, can be limited to rotate about axis A' through a prescribed angle, such as 30-60 degrees, as needed.

Figure 14:
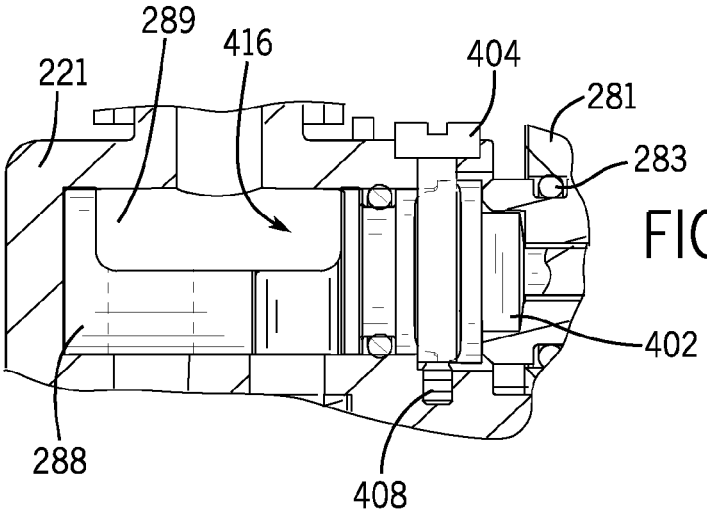
FIG. 14 is an enlarged partial sectional view of a mixing valve assembly of the modular faucet assembly of FIG. 10.
Figure 15:
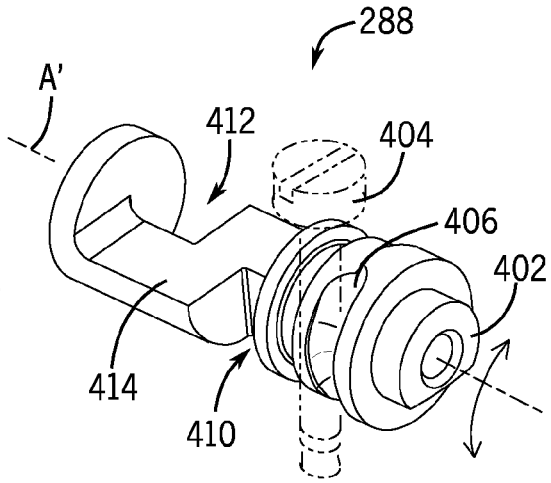
FIG. 15 is a perspective view of the mixing valve of FIG. 10 in isolation.
Figure 16:
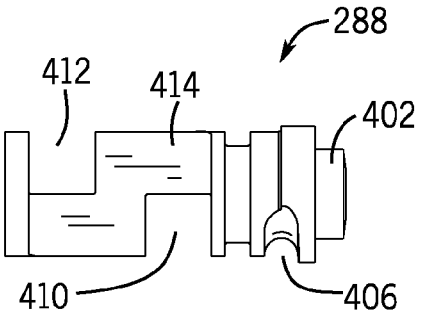
FIG. 16 is a plan view thereof.

Referring to FIGS. 15-16, first and second flow channels 410 and 412 are defined by a central portion 414 of the mixing spool 288. In addition, as depicted in FIG. 14, a cavity 416 is defined, which is in communication with the first and second channels 410 and 412. In operation, when the mixing valve 288 is positioned within the valve housing 289 as depicted in FIG. 14, the first and second flow channels 410 and 412 are in fluid communication with the passages 295 and 296 in the mounting shank 222. This configuration allows the separate fluid streams (e.g., relatively cold and hot water) to flow in equal proportion into the cavity 416, through the flow pipe 227 and into the spout 210. However, when the valve handle 281 is rotated on the axis A', the mixing spool 288 is rotated within the valve housing 289 such that the flow channels 410 and 412 are positioned to restrict or increase fluid flow from the passages 295 and 296. For example, in the illustrated example if the valve handle 281 is turned fully counterclockwise, the mixing spool 288 would rotate about axis A' so that the channel 410 would enable flow from the second passage 296 to remain fully open, whereas the channel 412 would be shut off from the passage 295, since the central portion 414 of the mixing valve 288 would obstruct the fluid flow from passage 295. Conversely, if the user were to turn the valve handle 281 fully clockwise, the channel 412 would enable flow from the passage 295 while the flow from passage 296 would be restricted, since in this case the central portion 414 of the mixing spool 288 would obstruct the fluid flow from passage 296. When the valve handle 281 is at some intermediate position between the midpoint and either fully clockwise or fully counterclockwise, the mixing spool 288 will allow proportional mixing of the fluid streams. It should be noted that the flow channels 410 and 412 can have rectilinear cross-sections, square in the illustrated example. This configuration has the effect of providing a more linear mixing ratio of the two fluid streams passing through the mixing spool 288, that when compared to circular or other non-linear cross-sectional configurations.

As with spout 110, the base end 213 of the spout 210 is configured to couple to the mounting base 221 by simply fitting the spout 210 down over the mounting base 221 in a simple plug-in type connection. The spout 210 decouples from the mounting base 221 then by simply unplugging it (i.e., pulling it up and away from the mounting base 221). More specifically, the spout 210 interfaces with the mounting base 221 primarily (if not entirely) at the interface of the flow pipes 203 and 227 with each other and the interface of the spout body 212 and the peripheral wall 329. In the example faucet 200, the spout 210 is positioned so that the flow pipe 203 formed in the base end wall 209 extends downwardly along the upright axis A and is fit around the flow pipe 227, which extends upwardly along the upright axis A. At the same time, the base end 213 of the spout 210 fits coaxially around the peripheral wall 229 of the mounting base 221. The nested structures can be brought in close relation, and if desired can be sized to contact the associated nested structure. The O-rings 223*a* and the O-ring 224 provide a snug, solid connection, and as mentioned at the interface of the flow pipes 203 and 227, a fluid tight seal. O-rings 223*a* and 224 thus further contribute to the coupling of the spout 210 to the mounting base 221. Further, when assembled, the mounting base 221 can be completely or partially concealed by the spout 210.

The example modular assembly of the faucet 200 allows the same base module 220 and control module 240 to be used with different spouts. For example, this modular construction permits replacement of the spout of previously installed faucet for functional or aesthetic reasons without replacing, or even disassembling, the other components of the faucet. Spouts having different external configurations but a common interface at the base end can be interchangeably mounted to the base module 120, thereby allowing for the faucet to be given an entirely different look, since the spout is the primary, if not only, externally visible component above the mounting deck. Moreover, the spout can be installed and removed from above the mounting deck to accommodate a wider range of spout designs and sizes, where only the spout 210 and sensor module 230 would be replaced.

The aforementioned connection is sufficient to securely couple the spout 210 to the mounting base 221 as needed during use of the faucet 200. However, the spout 210 can be further secured to the mounting base 221 so as to prevent unwanted rotation or removal of the spout 210 from the mounting base 221, for example, thus making it tamper resistant for use in public washrooms. For example, to further secure the spout 210 to the mounting base 221, two openings 206 can be located in the peripheral wall 229 of the mounting base 221 to receive fasteners 225 and 226. In one embodiment, the fastener 225 is a spring-biased locking pin and the fastener 226 is a screw. The spout 210 then has at least one hole 205 for aligning the spout 210 with the mounting base 221 and for receiving fastener 225 and 226. As described for faucet assembly 100, various mechanisms and fasteners can be used in addition to or in place of fasteners 225 and 226 to removably secure the spout 210 to the mounting base 221, including without limitation threaded fasteners, rivets, magnets, a threaded connection between the spout and mounting base, adhesives, welds, solder and a press-fit. Furthermore, various mechanisms can be used to disconnect the spout 210 from the mounting base 221 depending on the connection mechanism employed, including without limitation suitable tools and solvents as above. Additionally, the base module 220 can be any suitable construction such as cast or machined brass, molded plastic, or composite plastic with brass inserts. Also, suitable seals, gaskets and other connectors can be used in addition to or in place of O-rings 223 and 224 to provide water-tight connections at the spout-base module interface. Water-tight connections can also be included for assembling the sensor module 230 and the aerator 219 with the spout 210.

Referring now to FIG. 13, the control module 240 of the modular faucet assembly 200 is shown. The control module 240 includes a first 242 and second 342 solenoid valves operated by a battery powered electronic control module 279. The solenoid valve 242, including a spring biased plunger 276, wire coil 277 and valve head 278, which is operated by the battery powered electronic control unit 279. The control module 240 further includes a solenoid valve body 241 with upper and lower threaded ends 254 and 257, respectively. The lower, hollow, threaded end 264 of shank 222 is designed to couple to an upper end 273 of connector 270. Connector 270 has a first passage 272 with a lower end 274 and a second passage 271 with a lower end 275. The lower end 274 is in fluid communication with the upper end 254 of valve body 241. Suitable seals are positioned between each of the fluid connections for connector 270.

A first water supply line (not shown) connects to the lower end 257 to provide water to the solenoid valve inlet 269. The valve body 241 is in fluid communication with a plunger housing 256. The plunger housing 256 has a passage 255 in which plunger 242 is positioned to regulate fluid flow through the valve body 241. Energizing the solenoid valve 242 moves the plunger 276 along its stroke axis to unseat the valve head 278 to permit fluid flow through the valve body 241. The plunger housing 256 is sealed by coupling to spray shield 243, which also contains a recess 258 for accommodating plunger 242. The plunger housing 256 and spray shield 243 can be coupled together with fasteners 251.

In addition to sealing the plunger housing 256, the spray shield 243 functions to protect the components of the battery powered electronic control module. The electronic control module includes an electronics housing 246 of which an end wall is formed by spray shield 243. A gasket 250 is positioned between housing 246 and spray shield 243 to form a water-tight seal. The electronics housing contains a printed circuit board (PCB) 249 in electrical communication with the sensor module 230, the solenoid valve and a power supply or battery pack 245. One example of a suitable battery pack includes one or more AA batteries. A threaded bolt 259 extending from battery pack 245 is positioned in a compartment 265 of housing 246 in order to couple to a hex nut 247 positioned in an opposing face of the compartment 265. The result is that battery pack 245 is coupled to the electronics housing 246.

A second water supply line (not shown) connects to the lower end 357 of valve body 341 to provide water to the second solenoid valve inlet. The second solenoid valve 342 includes a spring biased plunger 376, wire coil 377 and valve head 378, which is operated by the battery powered electronic control unit 279. The control module 240 further includes a solenoid valve body 341 with upper and lower threaded ends 354 and 357, respectively. Connector 270 has a second passage 271 with a lower end 275. The lower end 275 is in fluid communication with the upper end 354 of valve body 341. Suitable seals are positioned between each of the fluid connections for connector 270. The valve body 341 is in fluid communication with a plunger housing 356. The plunger housing 356 has a passage 355 in which plunger 342 is positioned to regulate fluid flow through the valve body 341. The plunger housing 356 is sealed by coupling to cover panel 343, which also contains a recess 358 for accommodating plunger 342 (see FIG. 10). The plunder housing 356 and cover plate 343 can be coupled together with fasteners. The assembled housing contains additional elements of the solenoid valve such as a solenoid coil (not shown). In one embodiment, solenoid valves 242 and 342 are in electrical communication with PCB 249 of control module 240.

An additional component of the control module 240 is a wire, bus or other electrical conduit 248 with a terminal connector 253. The conduit 248 is in communication with the PCB 249 for receiving signals from sensor module 230. A sensor conduit (wire, bus, etc.) 237 of the sensor module 230 terminates in a sensor connector 238 which couples to connector 253. FIG. 12 illustrates an example path of the sensor conduit 237. Specifically, the conduit 237 is routed from the outlet end 211 of the spout 210, through the dry chamber 215, and through the opening 228 in the mounting base 221. The conduit 237 is connected below the deck 201 to conduit 248 by way of the connectors 238 and 253. Thus, the PCB 249 receives an input signal from the sensor module 230 via conduit 237 when the presence of a hand or other object near the spout 210 is sensed and energizes the solenoid valves 242 and 342 to open, and thereby water to flow through the valve bodies 241 and 341, into the connector 270 and bifurcated mounting shank 222 and on to ADM module 280 where the previously distinct streams are mixed. The mixed stream continues through the flow pipes 203 and 227, into the wet chamber 216 of the spout 210 and out through the outlet 117. The control circuitry can then close the solenoid valves 242 and 342 after receiving input from the sensor module 230 that the object has been removed from nearby the spout 210. As is known, timing circuitry can be used to provide flow for pre-set time period in order to resist tampering.

Referring to FIG. 11, an exploded view of the components of the sensor module 230 is illustrated. In one aspect, the sensor module 230 is analogous to sensor 130 of assembly 100. Sensor module 230 includes a sensor board (not shown) connected to conduit 237. A portion of the sensor board is nested in a bezel (not shown), which in turn is nested in a housing 139. A lens 232 is positioned on one end of the housing 239, while the conduit 237 extends out of the opposing end of the housing 239 (as for sensor module 130 in FIG. 9). FIG. 11 further shows a fastener 235 and retaining ring 236 for positioning the sensor module in the spout 210 as well as an O-ring 231 for providing a water-tight seal.

An opening 218 in the mouth 211 of the spout 210 is sized to accommodate the housing 239 of the sensor module 230. The O-ring 231 is positioned around the housing 239 and between the lens 232 and the opening 218 to form a water-tight seal. The fastener 235 is routed through a hole in the lens 232 and can be held in place prior to installation by the retaining ring 236. The fastener 235 is received in a hole above the opening 218 in order to couple the lens, and therefore the sensor module 230 to the spout 210. FIG. 9 shows a view of the assembled spout 210 with sensor module 230, where only the lens 232 and fastener 235 components are visible.

Again, the positioning and design of sensor module 230 are, in one embodiment equivalent to sensor module 130 as shown in FIGS. 1-8. By extension, the aerator 219 is advantageously mounted at an angle, $\alpha$, relative to the lens 232 of the sensor module 230. In particular, an end face of the aerator 219 is mounted such that the end face is positioned in a first plane, $P_1$. Moreover, an end face of the lens 232 is mounted such that the end face is positioned in a second plane, $P_2$, at an angle, $\alpha$, relative to the first plane $P_1$. Generally, the a has a value from about 0° to about 10°, preferably about 3° to about 7° and more preferably about 5°. Mounting the aerator 119 in a plane at a prescribed angle in this manner from the angle of the plane of the lens 132 provides several advantages. For example, when the faucet is in operation, a water stream flowing from the fluid outlet 117 is angled away from the lens 132 of the sensor module 130. Therefore, the lens 132 is less susceptible to either splashing or false detection of the water stream as an object by the sensor module 130. Also, the lens 132 is angled up from the aerator 119 to detect objects positioned above the sink, whereas the aerator 119 is angled down from the lens 132 to direct a water stream flowing from the fluid outlet 117 downward into the sink.

In FIGS. 10-13, the sensor module 230 is shown positioned above the aerator 219. However, in other embodiments the sensor module 230 can be positioned above, that is outward of, the aerator 219, or below (or inward of) the aerator 219, or in any other suitable location or orientation to be able to detect the presence of an person's hands or other objects within the basin of the lavatory, without detecting the presence of objects elsewhere. The sensor module 230 and aerator 219 can be any suitable conventional devices, including known filter and aerator cartridges and any suitable infra red, capacitance, ultrasonic field or other known sensor technology.

For this, or any of the other example faucet constructions, a remotely mounted ADM module for a motor-driven mixing valve can also be included with the faucet and operated by a master controller. Additionally, the faucet can be battery powered and/or include a low flow rate capable hydroelectric generator to recharge the battery or directly power the solenoid valves, control circuitry or other electronic components mounted on or used with the faucet. A latching type solenoid can be used in that case. An example of a commercially available battery-powered faucet with a hydro-generator and an ADM module is the Z6912-GEN-ADM EcoVantage Hydro Generator Faucet available from Zurn Industries, LLC.

Example faucets 100 and 200 provide a modular construction that permits the base modules 120, 220, water supply connections, and other below-the-deck components of the faucet to be used with different faucet products. It also allows the spout, and internal components, to be replaced with another of the same or different size, shape or function, from above the mounting deck in a simple plug-in type connection. A suitable quick-disconnect can be provided for the sensor wire to further the simple plug-in connection of the faucet. Moreover, a mechanical or electronic interlock feature can be included to ensure that the spouts 100 and 200 are removed from the base modules 120, 220 only when the water valve is closed.

Figure 17:
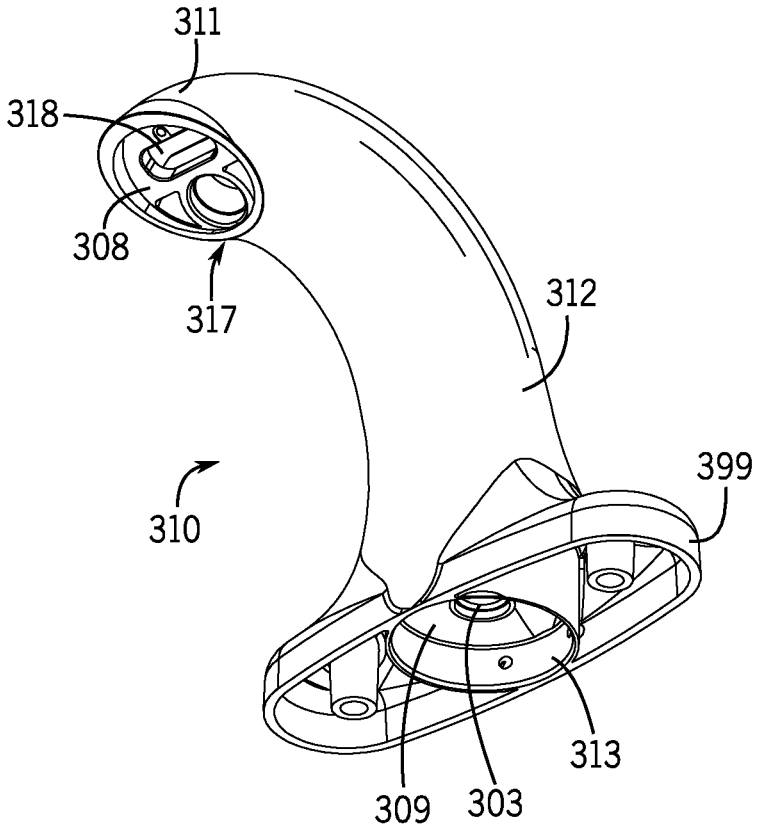
FIG. 17 is a perspective view of another example seamless spout body design that can be interchanged with the spout body of the faucet of FIG. 1.

It should be appreciated that the above generally describes only exemplary constructions of the modular faucet. Many modifications and variations to the described constructions will be apparent to those skilled in the art, which will be within the spirit and scope of the disclosure. A non-limiting example of alternative spout 310 is depicted in FIG. 17. As with spouts 110 and 210, spout 310 has an outlet end 311, a body 312 and a lower base end 313. The spout 310 possesses a wide base 399 in order to accommodate alternative faucet designs, such as centerset faucet configurations. Despite the different configuration of the exterior of the spout body 312, the interface, that is the base end wall 309, is configured in the same manner as base end wall 109, such that it can be interchangeably mounted directly to the mounting base 121. For example, a cylindrical channel 303 is positioned in the end 309 to enable coupling to a suitable base module.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. An electronically operated faucet having a sensor for activating a control valve controlling flow of water to the faucet, comprising:

a base having a flow pipe extending along an upright axis;

a spout defining a hollow interior bifurcated by an internal wall to provide a flow chamber between a mounting end and an outlet end of the spout, wherein the spout defines an internal wall extending across the flow cavity and having a flow pipe extending about the upright axis;

at least one seal; and a mounting shank having an interior passage and an upper end, wherein the base has an underside opening communicating with the flow pipe of the base and receiving the upper end of the mounting shank such that the interior passage of the mounting shank is in communication with the flow chamber when the spout is connected to the mounting base; and wherein the spout is removably coupled to the base and when coupled the flow pipes are configured to nest together such that the at least one seal is disposed between the flow pipes to provide a water tight seal of flow passing through the flow pipes and into the flow chamber.

2. The faucet of claim 1, further including a mixing valve and a handle lever connected to the mixing valve through an opening in an external shell of the spout, and where the base includes a valve channel receiving the mixing valve and communicating an underside passage of the base and with the flow pipe of the base.

3. The faucet of claim 2, further including a mounting shank having an internal partition defining first and second opening ended passages, each passage receiving different water flows, and wherein the mixing valve is configured to be operated to control the flow from the first and second passages into the flow pipe of the base.

4. The faucet of claim 3, wherein the mixing valve has at least one flow channel having a rectilinear cross-section.

5. The faucet of claim 3, wherein the control module includes two battery operated solenoid valves controlling flow through relatively warm and cold water lines communicating with one of the first and second passages of the mounting shank.

6. An electronically operated faucet, comprising:

a sensor;

a spout defining an external shell providing a hollow interior and defining internal wall structure extending into the hollow interior, the internal wall structure including an outlet end wall, a base end wall and a partition wall extending between the end walls so as to divide the hollow interior into a dry chamber and a wet chamber, the dry chamber being not in fluid communication with the wet chamber, wherein the outlet end wall has a first opening communicating with the dry chamber in which the sensor is received and a second opening communicating with the wet chamber, and wherein the base end wall has a first opening communicating with the dry chamber through which an electrical line passes to the sensor and a second opening communicating with the wet chamber through which water is passed to the second opening of the outlet end wall, the second opening in the base end wall having a flow pipe extending along an upright axis;

a mounting base having a peripheral wall extending within the hollow interior of the spout, wherein the mounting base has a flow pipe extending along the upright axis and sized to fit with the flow pipe of the base end wall to pass water through the flow pipes into the wet chamber, and wherein the mounting base has an opening communicating with the dry chamber through which an electrical line extends to the sensor;

a mounting shank having an interior passage and an upper end, wherein the mounting base has an underside opening communicating with the flow pipe of the mounting base and receiving the upper end of the mounting shank such that the interior passage of the mounting shank is in communication with the wet chamber when the spout is connected to the mounting base; and an electronic control module electrically coupled to the sensor by the electrical line to control water flow to the wet chamber of the spout;

wherein the spout couples to the mounting base by fitting the flow pipe of the base end wall and the external shell together with the flow pipe and peripheral wall of the mounting base.

7. The faucet of claim 6, wherein the spout is a monolithic structure including the external shell and internal wall structure.

8. The faucet of claim 6, further including at least one seal disposed between the flow pipes of the base end wall and the mounting base.

9. The faucet of claim 6, wherein the partition wall of the spout divides the hollow interior such that the wet chamber is larger than the dry chamber.

10. The faucet of claim 6, wherein the control module includes a battery operated solenoid valve.

11. The faucet of claim 6, further including an aerator disposed in the second opening of the outlet end wall of the spout.

12. The faucet of claim 11, wherein the sensor has a lens positioned at an angle relative to an outlet plane of the aerator.

13. The faucet of claim 12, wherein the angle is between 0 degrees and 10 degrees.

14. The faucet of claim 6, wherein the underside opening is a cylindrical passage of the mounting base aligned about the upright axis with the flow pipe of the mounting base.

15. The faucet of claim 14, further including at least one seal disposed between the cylindrical passage of the mounting base and the upper end of the mounting shank.

16. The faucet of claim 6, further including a mounting shank having a threaded portion for mounting the mounting base to a support structure and having at least one internal passage for fluidly coupling the control module to the flow pipe of the mounting base for delivering water to the wet chamber of the spout.

17. An electronically operated faucet, comprising:

a sensor;

a monolithic spout defining an external shell providing a hollow interior and defining internal wall structure extending into the hollow interior, the internal wall structure including an outlet end wall, a base end wall and a partition wall extending between the end walls so as to divide the hollow interior into a dry chamber and a wet chamber, the dry chamber being not in fluid communication with the wet chamber, wherein the outlet end wall has a first opening communicating with the dry chamber in which the sensor is received and a second opening communicating with the wet chamber, and wherein the base end wall has a first opening communicating with the dry chamber through which an electrical line passes to the sensor and a second opening communicating with the wet chamber through which water is passed to the second opening of the outlet end wall;

a mounting base having a peripheral wall extending within the hollow interior of the spout, wherein the mounting base has a cylindrical flow pipe and sized to fit within the second opening of the base end wall to pass water into the wet chamber, and wherein the mounting base has an opening communicating with the dry chamber through which an electrical line extends to the sensor;

at least one seal disposed between the cylindrical flow pipe of the mounting base;

an electronic control module electrically coupled to the sensor by the electrical line to control water flow to the wet chamber of the spout; and a mounting shank having an end received in an opening in the mounting base and having at least one internal passage for fluidly coupling the control module to the cylindrical flow pipe and the wet chamber of the spout and an upper end, wherein the mounting base has an underside opening communicating with the flow pipe of the mounting base and receiving the upper end of the mounting shank such that the interior passage of the mounting shank is in communication with the wet chamber when the spout is connected to the mounting base.

18. The faucet of claim 17, further including at least one seal disposed between the mounting base and the end of the mounting shank.

* * * * *